United States Patent [19]

Youngs

[11] Patent Number: 4,716,754

[45] Date of Patent: Jan. 5, 1988

[54] ROLL FORMING MACHINE

[75] Inventor: Wilbur R. Youngs, Scroggins, Tex.

[73] Assignee: Collier Metal Specialties, Inc., Garland, Tex.

[21] Appl. No.: 854,170

[22] Filed: Apr. 21, 1986

[51] Int. Cl.[4] ..... B21D 5/08

[52] U.S. Cl. ..... 72/178; 72/181

[58] Field of Search ..... 72/178, 176, 181; 493/178, 443, 424, 423, 442

[56] References Cited

U.S. PATENT DOCUMENTS

| | | | |
|---|---|---|---|
| 12,133 | 1/1855 | Kroehl | 72/178 |
| 421,961 | 2/1890 | Nauman . | |
| 726,691 | 4/1903 | Johnson . | |
| 808,356 | 12/1905 | Foster . | |
| 1,261,735 | 4/1918 | Hunker . | |
| 1,317,581 | 9/1919 | Kipniss et al. | 72/178 |
| 1,426,608 | 8/1922 | Schmidt | 493/178 |
| 1,673,787 | 6/1928 | Frahm et al. . | |
| 2,012,795 | 8/1935 | Park . | |
| 2,176,115 | 10/1939 | Yoder . | |
| 2,379,127 | 6/1945 | Werner | 493/423 |
| 2,405,128 | 8/1943 | Berquist . | |
| 2,471,490 | 5/1949 | Mercer | 72/178 |
| 2,505,241 | 4/1950 | Gray et al. | 72/178 |
| 2,637,365 | 5/1953 | Stockton | 72/178 |
| 2,682,850 | 7/1954 | Close . | |
| 2,948,324 | 8/1960 | Penrose . | |
| 3,748,884 | 7/1973 | Colbath | 72/238 |
| 3,903,723 | 9/1975 | Colbath | 72/178 |
| 3,914,971 | 10/1975 | Colbath | 72/178 |
| 3,945,232 | 3/1976 | Colbath | 72/181 |
| 4,588,393 | 5/1986 | Cogswell et al. | 493/443 |

OTHER PUBLICATIONS 4-page brochure: "Monitor, Inc. Presents Meta-Form", Monitor, Inc., Sherman, Tex.

*Primary Examiner*—Daniel C. Crane

*Attorney, Agent, or Firm*—Hubbard, Thurman, Turner & Tucker

[57] ABSTRACT

In accordance with the invention, a roll forming machine is provided having a plurality of sets of rotatable opposed drive rollers having parallel axes with each set of drive rollers including at least one forming edge. Each set of drive rollers also includes at least one rotatable forming roller opposite a forming edge and having its axis in a plane defined by the parallel axes of the set of drive rollers. The angle between the axes of the drive rollers and forming roller of each set is increased incrementally in successive sets. The contact surface of the drive roller defines a right circular cylindrical surface. The contact surface of the forming roller defines a frusto-conical surface and preferably a right circular cylindrical surface.

10 Claims, 24 Drawing Figures

ROLL FORMING MACHINE

This invention relates to a machine for roll forming strips or sheets of metal into desired shapes and more particularly for forming various shapes by mere adjustment of the machine and replacement of small components.

BACKGROUND OF THE INVENTION

Prior art machines are adept at forming metal strips or sheets into desired shapes. However, certain prior art machines such as those disclosed in U.S. Pat. Nos. 3,748,884, 3,903,723, 3,914,971 and 3,945,232, all by Colbath, are complicated and cumbersome to adjust to form different shapes. The basic Colbath machine, manufactured by Monitor, Inc. of Sherman, Texas, is composed of two parts. A lower frame supports a plurality of sets of drive rollers. An upper frame or spine supports a plurality of sets of forming rollers which are interleaved with the sets of drive rollers. The spine and its forming rollers are replaced by another spine to form another shape. The various spines and the overhead crane necessary to replace them add greatly to the expense of the machine and the use for forming of only every other station (those on the spine) renders the machine unnecessarily long, all for the purpose of rapid adjustment. The separation of the driving and forming functions also results in the leading edge of the workpiece being pushed through the forming rollers it encounters, causing buckling in lighter gauge metals and restricting effective use of the machine with lighter gauge metals to continuous strips rather than precut lengths.

Colbath U.S. Pat. No. 3,748,884 also discloses a roll forming machine having replaceable-spine-mounted combination drive-forming rollers connectable to adjacent frame-mounted drive motors. The rollers have a convoluted complimentary shape which scuffs the workpiece as it progresses through the machine. The entire spine and all rollers must be replaced to change shapes.

Yoder U.S. Pat. No. 2,176,115 the Johnson U.S. Pat. No. 726,691 both disclose earlier roll-forming machines which were not easily convertible to different shapes. Both use forming rollers having convoluted complimentary shapes. Other machines are disclosed by U.S. Pat. Nos. 421,961 to Nauman; 808,356 to Foster; 1,261,735 to Hunker; 1,673,787 to Frahm; 2,012,795 to Park; 2,405,128 to Berquist; 2,682,850 to Close and 2,948,324 to Penrose.

Therefore, it is an object of this invention to provide an improved roll forming machine.

It is a further object of this invention to provide a roll forming machine which may be easily and inexpensively adapted to form different shapes.

It is a further object of this invention to provide a compact, adjustable roll forming machine.

SUMMARY OF THE INVENTION

In accordance with the invention, a roll forming machine is provided having a plurality of sets of rotatable opposed drive rollers having parallel axes with each set of drive rollers including at least one forming edge. Each set of drive rollers also includes at least one rotatable forming roller opposite a forming edge and having its axis in a plane defined by the parallel axes of the set of drive rollers. The angle between the axes of the drive rollers and forming roller of each set is increased incrementally in successive sets. The contact surface of the drive roller defines a right circular cylindrical surface. The contact surface of the forming roller defines a frusto-conical surface and preferably a right circular cylindrical surface.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
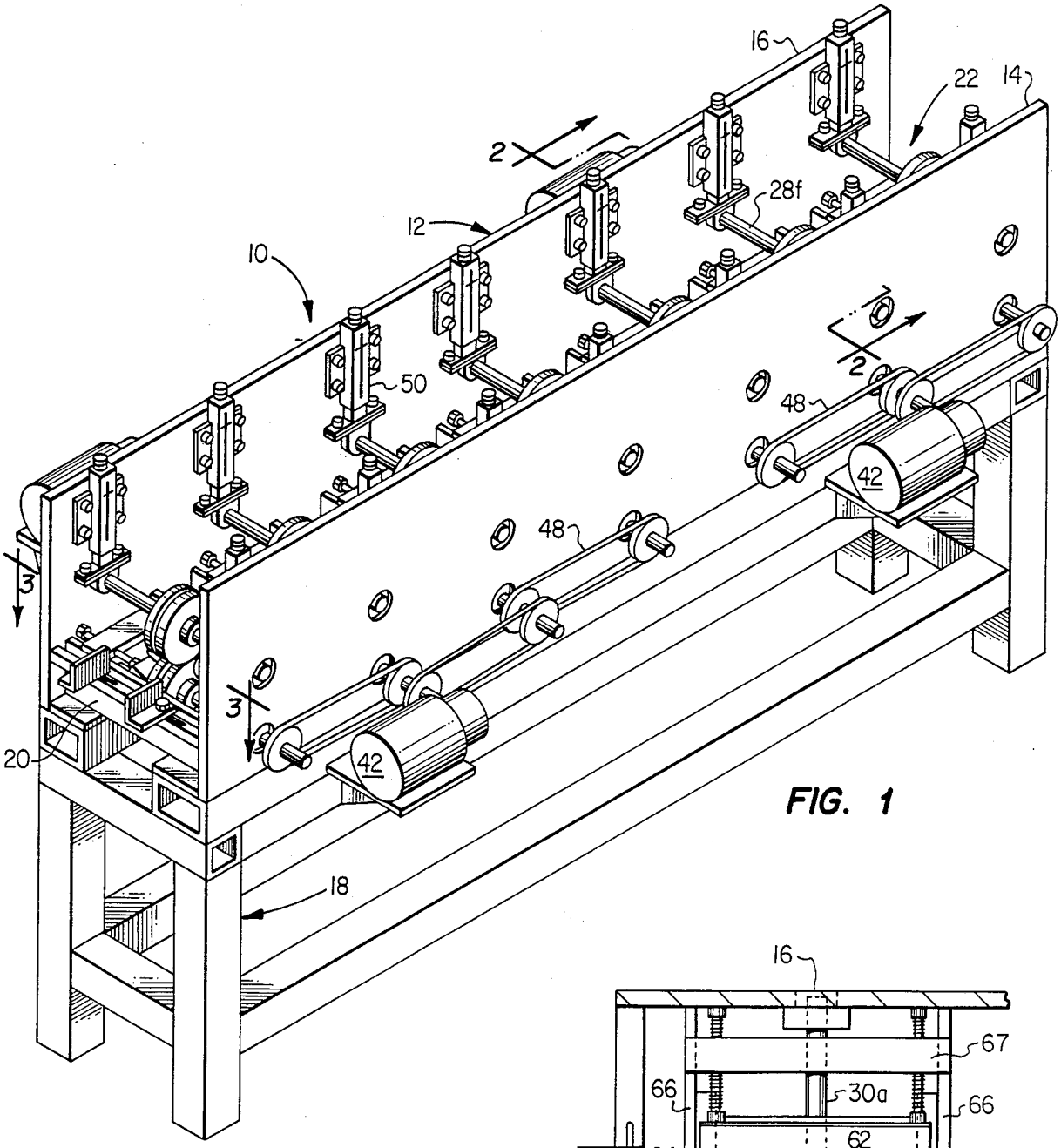
FIG. 1 is a perspective view illustrating an embodiment of the invention.

Turning first to FIG. 1, there is shown a roll forming machine 10 of the invention. The machine 10 has a frame 12 which includes a right side wall 14, a left side wall 16 and a base generally designated 18. Flat metal plates or strips called workpieces enter the machine 10 at a first end 20 and exit the machine after being formed at a second end 22.

Figure 2:
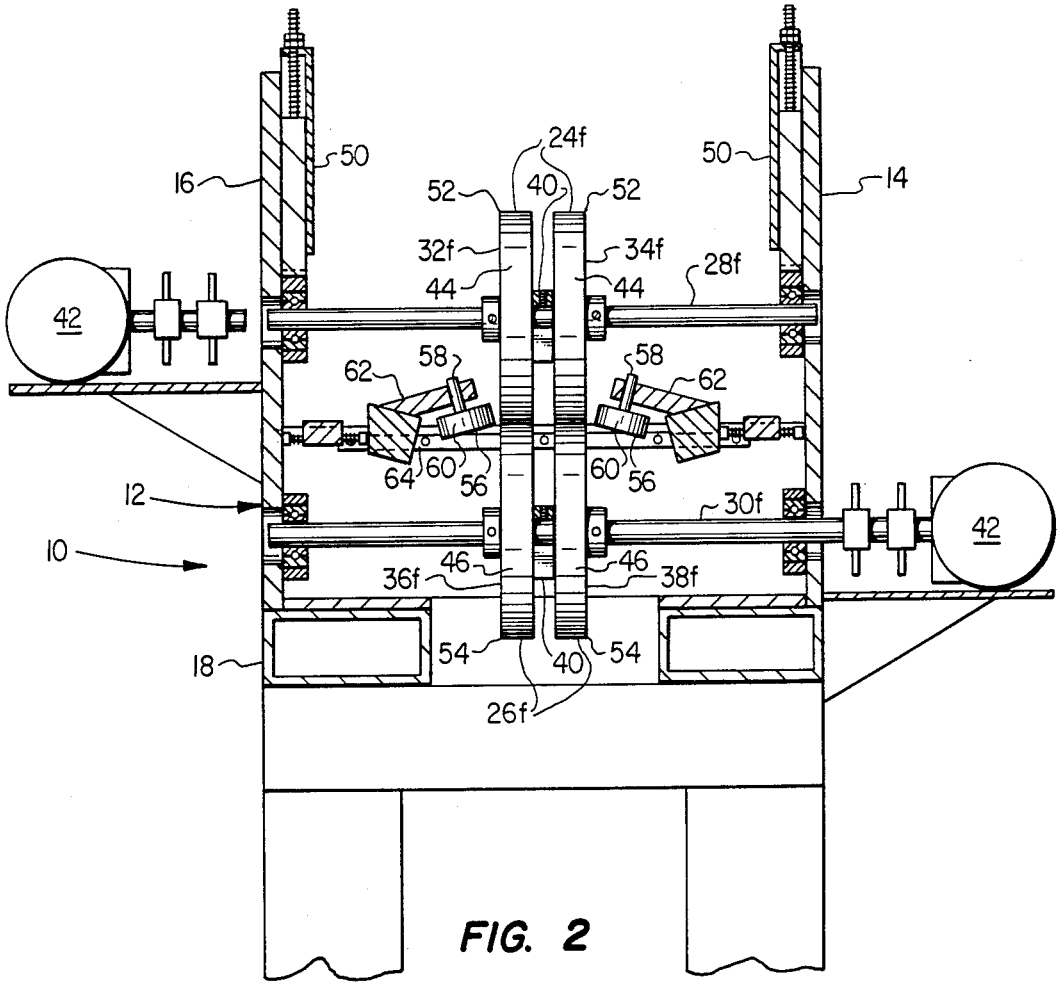
FIG. 2 is a sectional end view along line 2—2 of FIG. 1.

The machine 10 includes a plurality of sets of opposed drive rollers 24 and 26 such as the set of upper drive roller **24*f* and lower drive roller 26*f* shown in FIG. 2. The drive rollers 24 and 26 are mounted upon rotatable parallel axles 28 and 30 such as upper drive roller axle 28*f* and lower drive roller 30*f* shown in FIG. 2. Each drive roller 24 or 26 may include two drive wheels such as upper drive wheels 32*f* and 34*f* and lower drive wheels 36*f* and 38*f*, which two wheels may be spaced apart by a removable shim 40** of variable thickness.

The two upper drive wheels **32*f* and 34*f* are preferably right circular cylinders of the same diameter, preferably 8", which are fixedly axially movable along upper drive axle 28. By selecting the appropriate shim 40 anad fixedly moving the drive wheels 32*f* and 34*f* into engagement with the shim 40, a drive roller 24** of the desired width may be selected without replacing any drive rollers. The width of other upper and lower drive rollers may be similarly varied.

Figure 8:
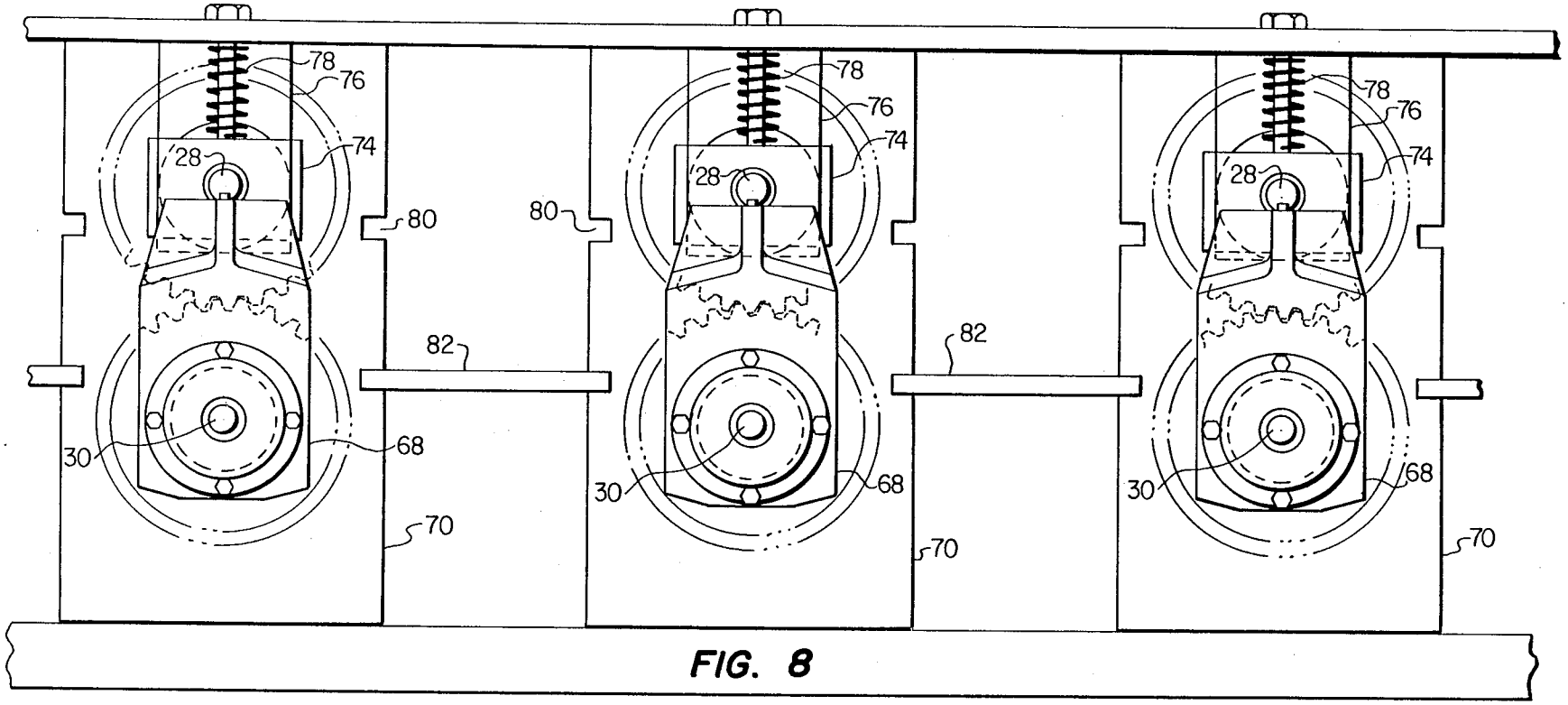
FIG. 8 is a partial side view of an alternative drive mechanism and forming roller mounting.

The upper drive roller 24 and the lower drive roller 26 of each set of drive rollers have opposing surfaces 44 and 46, respectively. These surfaces 44 and 46 each preferably define a right circular cylinder. By moving the adjustable upper axle mounting 50, a gap of appropriate thickness for the intended workpiece is selected between the opposing surfaces 44 and 46 of the drive rollers so that the drive rollers 24 and 26 exert an appropriate pressure on the workpiece to drive it through the machine 10. Alternatively and preferably, as shown in FIG. 8, an axle such as axle 28 carrying one of the drive rollers 24 is resiliently mounted to the frame 10 so as to accommodate workpieces of various thickness.

Figure 5:
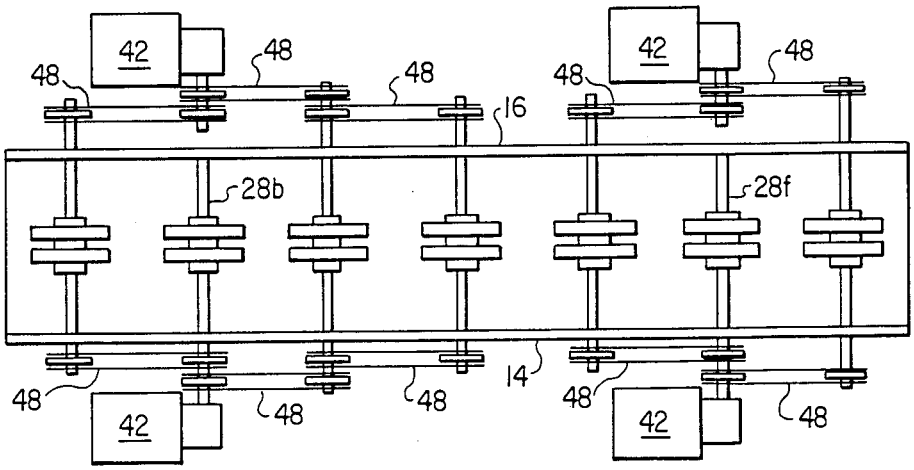
FIG. 5 is a schematic top view of the drive mechanism of the embodiment of FIG. 1.

At least one and preferably both of the drive rollers 24 and 26 of each set are driven, as by the motors 42 shown in FIG. 2 acting on the axles 28 and 30 of each set of drive rollers. The machine 10 of FIG. 1 has seven sets of drive rollers. As shown schematically in FIG. 5, all seven lower drive axles 30 are driven by the two motors 42 adjacent side wall 14 and by interconnecting chains 48. As also shown in FIG. 5, only five of the seven upper drive axles 28 are driven by the two motors 42 adjacent the left side wall 16 and by the interconnecting chains 48. The two undriven upper drive axles **28*b* and 28*f* which are in line with the output shafts of the two motors 42 can thus be adjusted vertically without requiring vertical movement of the drive motors 42**.

Returning to FIG. 2, the outer edges of the drive rollers 24 and 26 define pairs of forming edges 52 and 54. It can be seen that by varying the width of the drive rollers 24 and 26, as described earlier, the distance between the pairs of forming edges 52 and 54, can be selectively varied.

The machine 10 is also provided with rotatable forming rollers 56. The axles 58 of the forming rollers 56 are positioned parallel to and substantially within a plane defined by the two parallel drive axles 28 and 30 of the set of drive rollers.

Each forming roller presents a surface 60 opposite a forming edge 52 or 54 of the drive roller 24 or 26. The surface 60 defines a frustoconical surface or, preferably, a right circular cylindrical surface.

Figure 4:
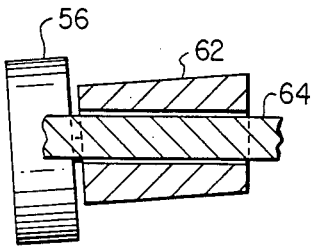
FIG. 4 is a partial sectional end view along lines 4—4 of FIG. 3.
Figure 3:
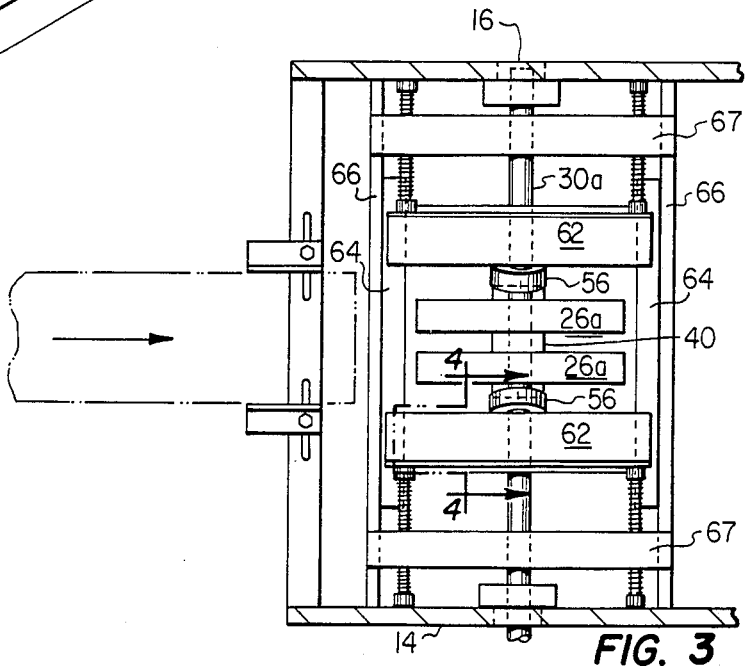
FIG. 3 is a partial sectional top view along lines 3—3 of FIG. 1.

The axle 58 of each forming roller 56 is carried by a block 62 which is slidably mounted upon a pair of transverse rails 64, as also shown in FIGS. 3 and 4. The transverse rails 64 are mounted to transverse bars 66 which extends between the side walls 14 and 16 of the machine 10. The transverse rails 64, however, do not extend to the side walls 14 and 16 but instead leave a gap between their ends and the respective side walls 14 and 16. The gap permits the block 62 to be slid away from the drive rollers, off the end of the rails 64 and removed from the machine 10. The same block 62 may be reinserted or another block 62 having a different forming roller 56 or different orientation of the forming roller axis 58 may be inserted. During operation of the machine 10, the block is held securely in place by adjustable shim 67.

As shown in FIG. 4, the block 62 has a groove cut into its end for cooperative engagement with the rail 64.

An alternative motor drive and upper axle mount is shown in FIG. 8. Each lower axle 30 is directly driven by an electric motor 68 located exterior of a right side wall 70. Each upper axle 28 is driven by a pair of spur gears 72 fixedly mounted to the upper and lower axles 28 and 30 interior of the right side wall 70. An upper axle bearing 74 is vertically slidably mounted within a slot 76 in the right side wall 70. The upper drive roller 24 carried by the upper axle 28 is urged into engagement with the workpiece and the lower drive wheel 26 by a spring 78. A similar upper bearing mounting is also used in the left side wall, not shown, without the motor 68 or spur gears 72.

Unlike the side wall 14 shown in FIG. 1, the side wall 70 shown in FIG. 8 is discontinuous and contains notches 80 in its edges. Flat plates 82 may be inserted into and withdrawn from the notches 80. The edges of the flat plates support the blocks 62 and shim 67 in the same manner as the rail 64 and bar 66 do. However, blocks 62 are removed and replaced by withdrawing the flat plate 82.

Notches 80 are provided equidistant above and below the centerline of the workpiece so that the same blocks may be used to form metal upwardly or downwardly.

Operation of the machine 10 is shown schematically by FIGS. 6A–6G, which illustrate the forming of a channel shape 84 from a workpiece 83 passing through the seven stations of machine 10. The legs 88 of the channel shape 84 will ultimately be bent upwardly 94° from the horizontal web 86. The initial station imparts a 4° bend to the workpiece 83, FIG. 6A, with each successive station imparting 15° more until 94° is reached, FIG. 6G.

Since both legs of the channel shape 84 are bent upwardly, only the two forming edges of the upper drive rollers 24 are used. Had either leg been bent downwardly, forming edges 54 of the lower drive rollers 26 would have also been used.

Figure 6A:
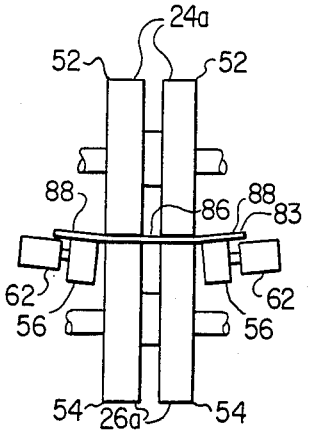
FIGS. 6A–6G are a schematic representation of the progressive forming of a channel shape by the embodiment of FIG. 1.
Figure 6B:
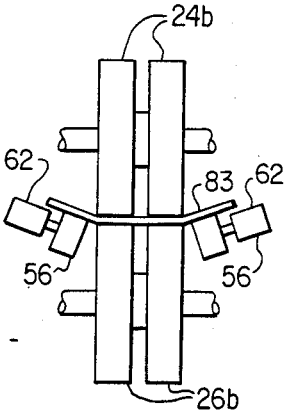
Figure 6C:
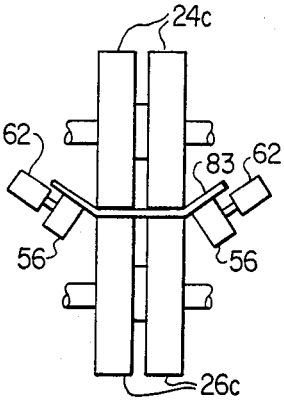
Figure 6D:
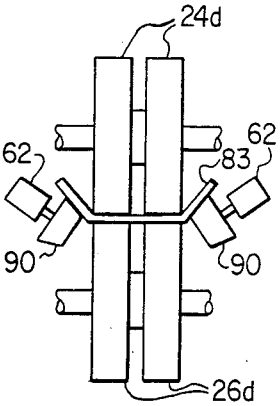
Figure 6E:
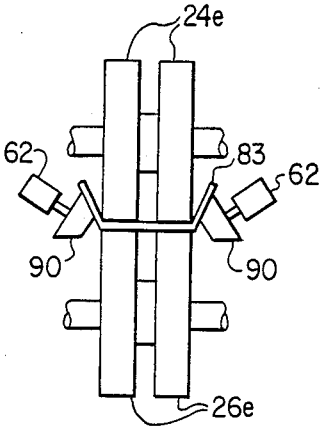
Figure 6F:
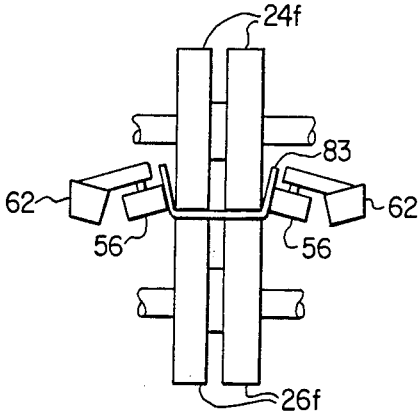

FIGS. 6D anad 6E depict a less preferred forming roller 90 having a frusto-conical surface opposed to the forming edge 52 of the drive rollers 24. Because the diamter of the forming roller 90 varies, it scuffs the surface of the workpiece 83 and may require lubrication. FIGS. 6A–6C and 6F–6G depict the preferred forming roller 56 having a right circular cylindrical surface opposed to the forming edge.

Figure 6G:
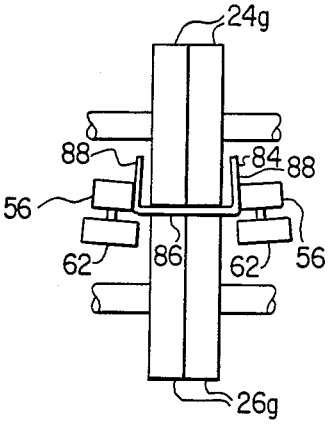

The drive rollers **24*g* and 26*g* shown in FIG. 6G are narrower than the drive rollers shown in FIGS. 6A–6F so that the forming rollers 56 may bend the legs 88** past 90° without interference from the drive rollers.

FIGS. 9A–9E show the formation of a Z-purlin shape 94 from a workpiece 92. Although only five workstations are shown, twelve are contemplated, each bending the workpiece 92 an additional 15°.

Figure 9C:
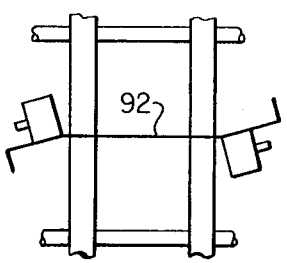
FIGS. 9A–9E are a schematic representation of the progressive formation of a Z-purlin shape by the invention.
Figure 9E:
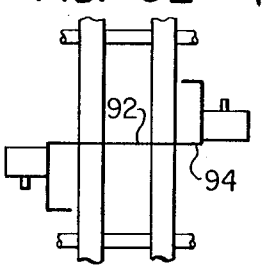
Figure 9B:
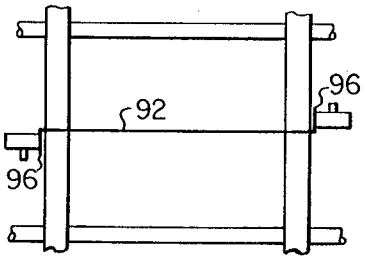
Figure 9D:
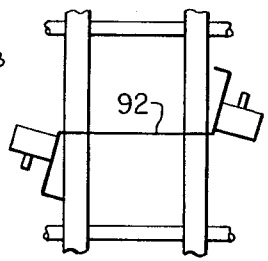
Figure 9A:
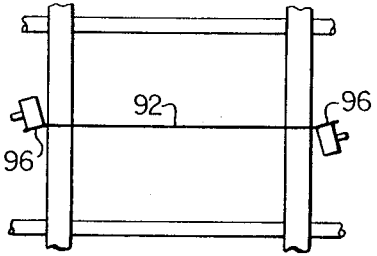

FIG. 9A shows the first workstation wherein the ends 96 are first bent 15°. FIG. 9B shows the sixth workstation, where the ends are bent to their final 90° angle.

FIG. 9C shows the third workstation, wherein the initial 15° bend is imparted to the legs 98. FIG. 9D shows the eleventh workstation, where the legs 98 are bent to 75° from the web 100. FIG. 9E shows the final workstation where the legs are bent to their final 90° angle. Note that the drive rollers have been narrowed in FIG. 9E so that they do not interfere with the ends 96 when the legs 98 are bent to their final 90° position.

Figure 7A:
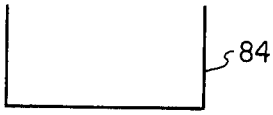
FIGS. 7A–7F are various shapes which may be formed by the invention.
Figure 7B:
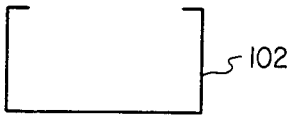
Figure 7C:
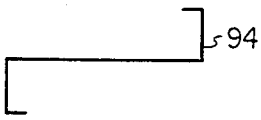
Figure 7D:
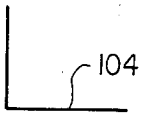
Figure 7E:
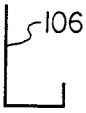
Figure 7F:
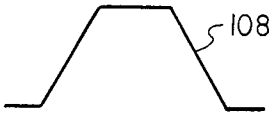

FIGS. 7A–7F shown various shapes which may be made by the invention. FIG. 7A shows a channel shape 84 and FIG. 7B shows a C-stud shape 102. FIG. 7C shows a Z-purlin shape 94 and FIG. 7D shows an angle shape 104. FIG. 7E shows a hat section shape 106 and FIG. 7F shows a J-section shape 108.

Thus it is apparent that there has been provided, in accordance with the invention, a roll forming machine that fully satisfies the objects, aims and advantages set forth above. While the invention has been described in connection with specific embodiments thereof, it is evident that many alternatives, modification and variations will be apparent to those skilled in the art in light of the foregoing description. Accordingly, it is intended to embrace all such alternatives, modifications and variations as fall within the spirit and broad scope of the appended claims.

What is claimed is:

1. A roll forming machine, which comprises:

a frame including spaced apart substantially parallel side walls;

a plurality of sets of drive rollers supported on said frame at spaced apart points along a predetermined path, each of said sets of drive rollers including an upper and a lower opposed drive roller rotatable about parallel axles, and axes of each set define a plane, at least one of said upper and lower drive rollrs being rotatably driven;

a plurality of pairs of support rails supported between said side walls substantially parallel to said axes of said drive roller axles, each drive roller set having associated therewith a pair of support rails with each of said support rails of a pair being spaced apart from each other on opposite sides of said plane defined by said axes of said set of drive roller axles, the ends of said support rails being spaced apart from said side walls and positioned on transverse bars connected between said side walls;

a plurality of support blocks, each of said support blocks being slidingly mounted on and between one of said pairs of support rails;

shim means for adjustably positioning said support blocks at selected positions along said support rails;

and a plurality of forming rollers, each of said forming rollers being supported by one of said support blocks on axles having an axis lying in said defined plane each forming roller oriented to successively deflect sheet material transverse to its movement through the machine.

2. The roll forming machine of claim 1 wherein:

each of said drive rollers includes only one surface opposed to the other, the opposing surface of each drive roller defining a right circular cylindrical surface, at least one of said upper and lower drive rollers having a forming edge;

and each of said forming rollers having a forming surface opposed to one of said forming edges.

3. The roll forming machine of claim 2 wherein the opposing surface of the forming roller defines a frustoconical surface.

4. The roll forming machine of claim 2 wherein the opposing surface of the froming roller defines a right circular cylindrical surface.

5. The roll forming machine of claim 4 wherein each of the upper and lower drive rollers includes a pair of rollers mounted on a common axle and fixedly movable along the axle, with each of said pair of rollers having only one opposing surface and with the two opposing surfaces of each pair of rollers defining only one right circular cylinder.

6. The roll forming machine of claim 5 wherein the angle defined by the intersection of the axis of the forming roller and the axes of a driving roller increases incrementally in successive sets of rollers along the predetermined path.

7. The roll forming machine of claim 6 having two forming rollers and wherein the set of said upper and lower drive rollers has two forming edges adjacent opposing surfaces of said set of drive rollers and wherein one of said forming rollers is opposed to each forming edge.

8. The roll forming machine of claim 7 wherein the angles formed by the intersections of the axes of the two forming rollers with the axes of the driving rollers are substantially equal.

9. The roll forming machine of claim 4 wherein one of said upper and lower drive rollers is resiliently supported on said frame so as to accommodate workpieces of various thicknesses.

10. The roll forming machine of claim 4 further including means for removal and replacement of the forming roller.

* * * * *